US006206987B1

(12) United States Patent
Rode et al.

(10) Patent No.: US 6,206,987 B1
(45) Date of Patent: Mar. 27, 2001

(54) METHOD FOR MANUFACTURING A CASTING-DIE BODY AND A CASTING-DIE BODY

(75) Inventors: Dirk Rode, Osnabrück; Hans-Jürgen Hemschemeier, Ibbenbüren; Ralf Rethmann, Georgsmarienhütte, all of (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/213,074

(22) Filed: Dec. 16, 1998

(30) Foreign Application Priority Data

Dec. 17, 1997 (DE) ..... 197 56 164

(51) Int. Cl.[7] ..... C22F 1/08
(52) U.S. Cl. ..... 148/519; 148/536
(58) Field of Search ..... 148/519, 522, 148/536

(56) References Cited

U.S. PATENT DOCUMENTS 4,688,320 * 8/1987 Ushio et al. ..... 29/527.4
5,252,147 * 10/1993 Verhoeven et al. ..... 148/237

FOREIGN PATENT DOCUMENTS 31 42 196 5/1983 (DE) .

* cited by examiner

*Primary Examiner*—George Wyszomierski
(74) *Attorney, Agent, or Firm*—Kenyon & Kenyon

(57) ABSTRACT

A casting-die body (1) made of a hardenable copper alloy is provided with an inner wear-protective layer (7) of chromium whose hardness decreases from the billet-side surface (8) in the direction of the casting-die body (1). The wear-protective layer (7) is made up of two chromium layers (9, 10). For this purpose, the casting-die body (1) is given a solution heat treatment, is chromium plated, and is then hardened, as a result of which the initially very great hardness of the chromium layer (9) is reduced. The hardness of the chromium layer (9) then is about 650 HV. Subsequently, to increase the wear protection, the second chromium layer (10) is applied. The result is a conventional chromium-plated layer having a hardness of between 850 HV and 1050 HV.

4 Claims, 1 Drawing Sheet

METHOD FOR MANUFACTURING A CASTING-DIE BODY AND A CASTING-DIE BODY

BACKGROUND OF THE INVENTION

1. Field of the Invention

The invention relates to a method for manufacturing a casting-die body and to a casting-die body made of a hardenable copper alloy.

2. Description of Related Art

The casting die is one of the most important components of a continuous casting installation. The solidification of the melted mass begins in it. The principal design is generally composed of an external steel structure and the actual form-giving part of the casting die, the casting-die body. Today the casting-die body is almost exclusively made of copper or a copper alloy. The steel casing has the task of positioning the casting-die body and assuring the water circulation necessary for cooling.

The resistance to wear of copper alloys is relatively small. In particular, at the foot of the casting-die body, there is the danger of increased friction between the steel billet and the wall of the casting-die body as a result of differences between the casting-die body geometry and the shrinkage behavior of the steel, or as a result of insufficient guidance of the billet inside the casting die. Consequently, significant abrasion along with corresponding changes in shape of the casting-die body can occur.

For reasons of protection against wear, the casting-die body is therefore provided with an interior layer made of a wear-resistant material such as nickel or chromium. A casting-die body of this type having a wear-protective layer is found, for example, in German patent 31 42 196 C2. In this way, an improvement in the abrasion characteristics and thus an increase in the service life of the casting-die body can be achieved.

A chromium layer, in this connection, is distinguished by its greater hardness in comparison with nickel, and by its increased wear-protection, associated therewith. Therefore, an electroplated coating of the interior surface with hard chromium offers effective protection against wear.

However, due to the varying heat-expansion coefficients of the materials of the casting-die body and of the wear-protective layer, significant stresses arise in the wear-protective layer. As a result, the resistance to adhesion suffers and there is the danger of peeling or forming cracks.

SUMMARY OF THE INVENTION

Therefore, the invention is based on the objective, derived from the Prior Art, to indicate a method of manufacturing casting lie bodies made of a hardenable copper alloy and of an interior wear-protective layer of chromium having improved adhesion between the casting-die body and the wear-protective layer. In addition, the goal of the invention is a qualitatively improved casting-die body, which will make possible longer service lives.

These and other objects of the invention are achieved by a method for manufacturing a form-giving casting-die body of a casting die for a continuous casting installation, comprising the steps of solution heat treating a casting-die body made of a hardenable copper alloy, subsequently applying a wear-protective layer to the casting-die body, and hardening the casting-die body.

BRIEF DESCRIPTION OF THE DRAWINGS

The invention is described below on the basis of an exemplary embodiment depicted in FIG. 1 which illustrates a casting die tube in accordance with the invention.

DETAILED DESCRIPTION OF THE INVENTION

Figure 1:
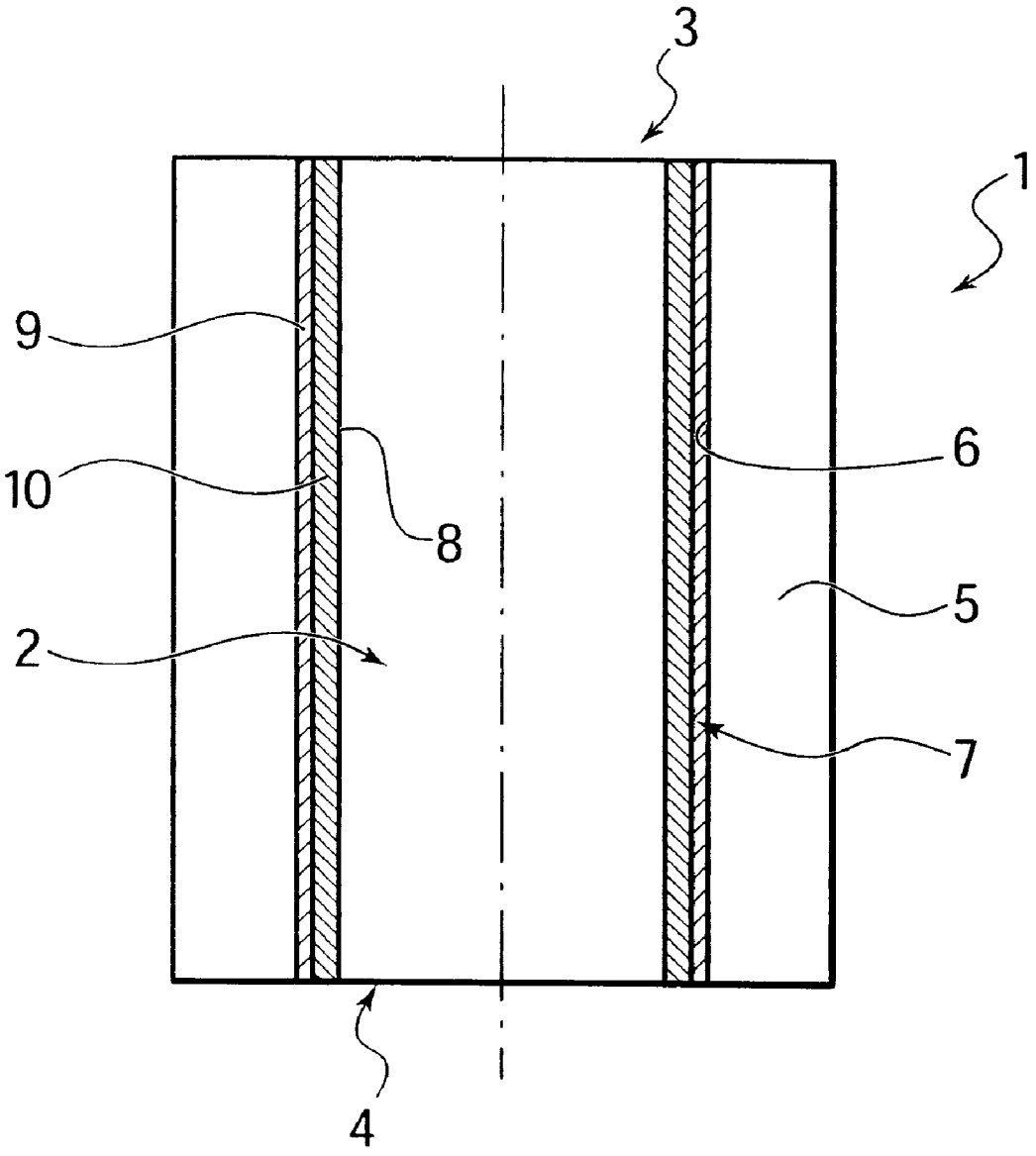

After the solution heat treatment, the casting-die body made of a hardenable copper alloy is provided with an inner layer of chromium, and is subsequently hardened.

As a result of this heat treatment, the initially great hardness of the wear-protective layer is reduced, with the result that ductility is increased. Thus the differences in the material properties of the copper alloy of the casting-die body and the wear-protective layer of chromium are smaller, thus substantially reducing the danger of damage to the chromium layer resulting from the differing properties.

The casting-die body can in principle be a one-part casting die tube or a multi-part casting die, for example a plate-type casting die.

The hardening may take place with a protective gas in a reducing atmosphere. In this way, the casting-die body attains its ultimate strength.

The hardening temperature is determined by the desired hardness of the wear-protective layer to avoid a too-strong softening of the chromium layer. It is preferable that the hardening be carried out at a temperature between 400° C. and 550° C.). Good results have been achieved in practical tests using a temperature of 460° C. with a protective gas, the heat treatment lasting 10 hours. In this context, the goal was a hardness of the wear-protective layer of 650 HV to 700 HV (Vickers hardness). The wear-protective layer then possesses a sufficient degree of hardness, but also, as a result of the increased ductility, an improved adhesive strength and a lower tendency to generate cracks.

An advantageous refinement of the method according to the present invention is when the wear-protective layer is configured in two layers, with the inner surface being chromium-plated once again after the hardening process. The chromium layer is preferably deposited electrolytically.

In this way, a multilayer chromium-plating having a gradual transition of hardnesses is achieved. The risk of forming cracks and peeling is thus significantly reduced. In addition, it is possible through this measure to realize greater layer thicknesses of the chromium wear-protective layer.

The crucial point of a casting-die body according to the invention is that the hardness of the wear-protective layer decreases from the surface on the billet side in the direction of the casting-die body.

In this way, the material stresses resulting from the varying material properties at the layer transition the casting-die body and the wear-protective layer can be reduced.

Proceeding from the copper alloy, the hardness can be increased gradually. In this context, an increase occurs from the soft copper alloy of the casting-die body through the tube-side chromium layer, having greater hardness, to the greatest hardness of the chromium layer on the billet side.

The tube-side chromium layer may have a hardness of between 500 HV and 850 HV, in contrast to which the billet-side chromium layer has a hardness of between 850 HV and 1050 HV.

The layer thicknesses of the tube-side and billet-side chromium layers are preferably between 100 $\mu$m and 150 $\mu$m. a total layer thickness of approx. 250 $\mu$m being seen as particularly favorable in practice.

The wear-protective layer may have a constant thickness in the casting direction. But it is also possible in principle that the thickness of the wear-protective layer increase in the casting direction. In this way, a high wall temperature is assured in the area of the meniscus, with a simultaneous increase of wear protection in the casting direction. In this way, the cooling stretch of the casting-die body available for the solidification process can be effectively adjusted to the shrinkage behavior of the billet. The layer thickness can change in a linear or stepwise fashion.

FIG. 1 illustrates a casting die tube 1 for the continuous casting of steel. Casting die tube 1 has a mold cavity 2, whose cross section at pouring-in-side front end 3 is dimensioned greater than at billet-exit-side foot end 4.

Basic body 5 of casting die tube 1 is made of a copper alloy, preferably on a copper/chromium/zirconium basis (CuCrZr).

On interior side 6, casting die tube 1 is provided with a wear-protective layer 7 of chromium. Wear-protective layer 7 is configured in two layers, the hardness of wear-protective layer 7 decreasing from billet-side surface 8 in the direction of casting die tube 1 and inner side 6 of casting die tube 1.

In this context, wear-protective layer 7 is composed of two separate wear-protective layers, chromium layers 9 and 10, having different hardnesses. Tube-side chromium layer 9 preferably has a hardness of 650 HV. Billet-side chromium layer 10, in contrast, having a hardness of 1000 to 1050 HV, is harder.

To produce first chromium layer 9, casting die tube 1 and its basic body 5 are chromium plated in a solution-heated state and then are hardened in a heat treatment. In this way, casting-die body 1 obtains its ultimate strength. After being age hardened, chromium layer 9 has a hardness of 650 HV. To increase the wear protection, in a further coating procedure, second chromium layer 10 is applied, which has a hardness of 1050 HV.

Wear-protective layer 7, in its entirety, is 250 $\mu$m thick, the layer thickness of the chromium layer 9 being 100 $\mu$m and the layer thickness of chromium layer 10 being 150 $\mu$m.

The advantage of the two-layer wear-protective layer 7 lies in a decreased difference between hardness and ductility at the transition from basic body 5 to chromium layer 9, while assuring, as a result of chromium layer 10, great hardness at billet-side surface 8.

What is claimed is:

1. A method for manufacturing a form-giving casting-die body of a casting die for a continuous casting installation, comprising the steps of solution heat treating a casting-die body made of a hardenable copper alloy, subsequently applying a wear-protective layer of chromium to the casting-die body, and thereafter hardening the casting-die body.

2. The method recited in claim 1, wherein the hardening takes place in a protective-gas atmosphere.

3. The method recited in claim 1, wherein the hardening is conducted at a temperature between 400° C. and 550° C.

4. The method recited in claim 1, wherein a two-layer wear-protective layer is formed by providing a second wear-protective layer by chromium plating the casting-die body having a first wear-protective layer after the hardening step.

* * * * *